United States Patent [19]

Haug

[11] Patent Number: 4,726,129

[45] Date of Patent: Feb. 23, 1988

[54] SNOW TILLER

[75] Inventor: Walter Haug, Blaustein, Fed. Rep. of Germany

[73] Assignee: Karl Kassbohrer Fahrzeugwerke GmbH, Ulm/Donau, Fed. Rep. of Germany

[21] Appl. No.: 895,711

[22] Filed: Aug. 12, 1986

[30] Foreign Application Priority Data

Dec. 24, 1985 [DE] Fed. Rep. of Germany ... 8536530[U]

[51] Int. Cl.[4] ..... E01H 4/00

[52] U.S. Cl. ..... 37/222; 172/197; 172/772; 172/772.5; 172/684.5

[58] Field of Search ..... 37/219, 220, 221, 222; 172/197–198, 772, 772.5, 773, 764, 765, 767, 753, 684.5

[56] References Cited

U.S. PATENT DOCUMENTS

| | | | |
|---|---|---|---|
| 3,795,069 | 3/1974 | Cheney | 172/684.5 |
| 3,878,900 | 4/1975 | Boisse et al. | 172/197 |
| 3,915,239 | 10/1975 | Hendrichon | 172/197 |
| 4,014,116 | 3/1977 | Baechler | 37/221 |
| 4,136,983 | 1/1979 | Dobberpuhl | 172/753 |
| 4,341,027 | 7/1982 | Rohner | 37/221 |
| 4,523,398 | 6/1985 | Scheibel et al. | 37/220 |
| 4,572,301 | 2/1986 | Bourgeois, Jr. | 172/684.5 |

*Primary Examiner*—E. H. Eickholt

*Attorney, Agent, or Firm*—Thompson, Birch, Gauthier & Samuels

[57] ABSTRACT

The invention relates to a snow tiller for mounting on the rear of a track maintenance vehicle. The snow tiller comprises a tiller shaft and a tiller frame of at least triangular cross-section extending over the width of the snow tiller and having end plates for supporting the tiller shaft bolted to its lateral ends.

In order to facilitate the maintenance of the snow tiller, the lateral ends of the tiller frame are provided with bars secured thereto in a V-shaped configuration. Secured to each end plate at its side facing towards the tiller frame is a pair of undercut bars in a V-shaped configuration for overlapping engagement with the bars on the tiller frame in the mounted state of the end plates. The undercut bars cooperate with a fixing bolt engaging the tiller frame to form an interlock clamp mounting arrangement.

22 Claims, 11 Drawing Figures

Figure 1:
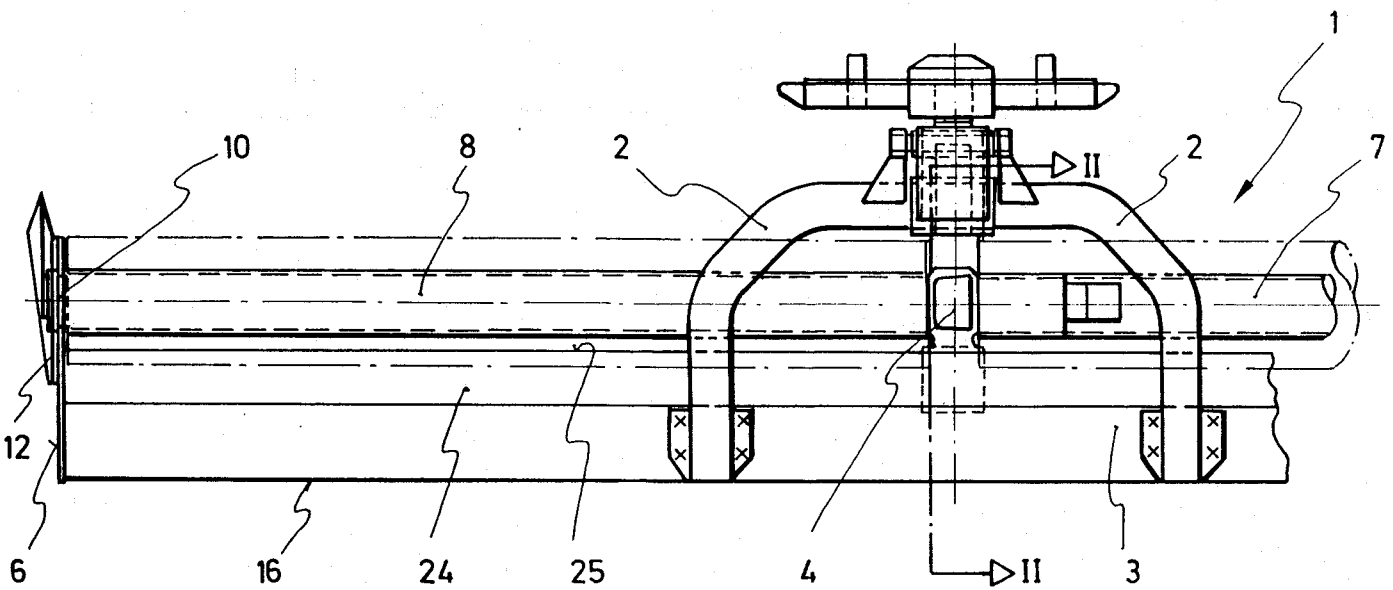

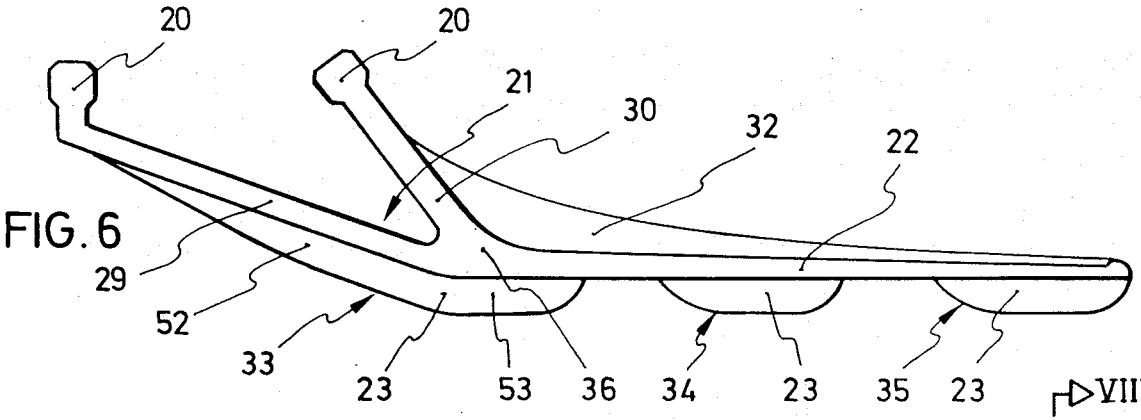
FIG. 6
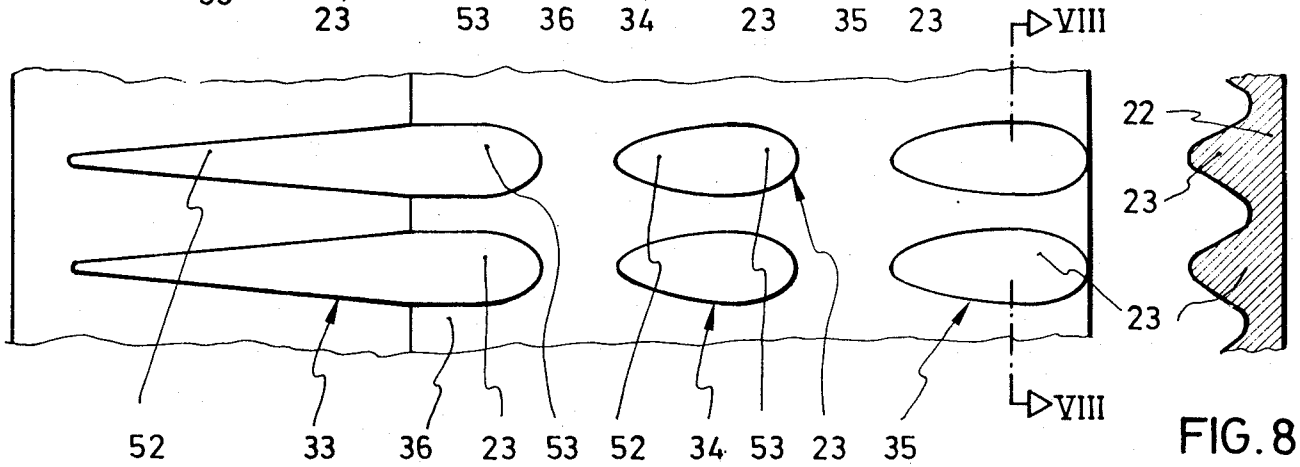
FIG. 7
FIG. 8

SNOW TILLER

The present invention relates to a snow tiller to be mounted on the rear of a track maintenance vehicle, comprising a tiller shaft and a tiller frame having a multi-sided cross-sectional shape extending over the width of the snow tiller and having end plates provided with bearings for the tiller shaft bolted to its lateral ends.

A snow tiller of this type is already known from DE-GM No. 85 28 096 originating from the present applicant. The tiller frame shown in this publication is of parallelogram-shaped cross-sectional configuration, so that in cross-section pairs of tiller frame surfaces for two sides of a triangular shape.

In the known snow tiller the tiller frame is designed as a central frame having a transmission mounted at its center for driving two tiller shafts laterally connected thereto. The ends of the tiller shafts facing away from the transmission are supported in outer bearings.

It is an object of the present invention to further improve known snow tillers, particularly with regard to facilitating their handling and maintenance.

This object is attained according to the invention by the provision that the tiller frame has at each of its lateral ends bars projecting beyond two frame surfaces in a cross-sectional plane and arranged in a V-shaped configuration relative to one another, and that each of said end plates has two undercut bars secured thereto in a V-shaped configuration at the side thereof facing the tiller frame, the undercut bars being adapted in the mounted state of the end plates to overlap the bars on the tiller frame and cooperating with a fixing bolt engaging the tiller frame to establish an interlocked clamp mounting.

This solution enables the side end plates, and thus the bearings for the tiller shaft, to be rapidly mounted and dismounted. The V-shaped undercut bars of each end plate overlapping the bars on the tiller frame are effective to always ensure proper alignment of the outer bearings of the tiller shaft. A further advantage is to be seen in the fact that only a single bolt has to be loosened and tightened for each end plate, whereby the time required for replacing worn tiller shafts is noticably shortened. It is possible to have the bars on the tiller frame extend outwards over the frame surfaces, so that they can be overlappingly engaged from outside by the undercut bars on the end plates. It is also possible, however, particularly when the tiller frame is formed as a tubular member, to have the bars project inwards, so that the undercut bars on the end plates are engaged therewith from inside the tiller frame. In any case it is important that the two undercut bars include substantially the same angle as the bars, it being possible that the undercut bars as well as the bars are formed by a single undercut bar or bar, respectively, bent to a V-shaped configuration.

The replacement of the end plates is particularly facilitated when the axis of the fixing bolt is substantially aligned in the direction of the angle bisector of the two bars. In this case the undercut bars on the end plates may initially be engaged with the bars on the tiller frame to only such an extent that the fixing bolt can be engaged both with the tiller frame and the end plate. Subsequent tightening of the fixing bolt will then cause the two V-shaped bars to be literally pulled into the two V-shaped undercut bars to thereby properly align and finally secure the end plate in position.

In accordance with a preferred embodiment, the undercut bars overlap the bars from outside when the end plate is mounted, and the fixing bolt is provided on the tiller frame at a spaced location from the said tiller frame surfaces.

Mounting of an end plate is further facilitated by the provision that to one side of the tiller frame there is provided an insertion pocket for the end plate opening towards the V-shaped bars, the fixing bolt engaging the end plate through the insertion pocket and being formed as a tension bolt. In this manner a certain alignment is already achieved when the end plate is slipped onto the bars, the end plate being guided by the insertion pocket designed to absorb any lateral forces occurring at this stage, so that these forces do not act on the fixing bolt. If the insertion pocket is located on the side of the tiller frame opposite the bars, the end plate is locked in position in a particularly effective manner.

The bars on the tiller frame can be formed in a particularly simple manner by the provision of a likewise triangular end cover secured to the lateral end of the tiller frame and projecting beyond the cross-sectional area thereof. Such an end cover offers the additional advantage that it keeps a tiller frame formed as a tubular member closed even when the end plates are dismounted.

A particularly effective guidance of the end plate during its insertion may be achieved by the provision that the end portion of the end plate facing towards the insertion pocket is formed with a corresponding bent-off insertion tongue having a nut secured thereto.

The accessibility of the fixing bolts of the end plates is improved by the provision that the tiller frame is formed as a baffle body and that the transverse edges of the tiller frame extend upwards from its center. When the snow tiller is dismounted from the track vehicle, this provision results in the tiller frame assuming a bi-stable attitude which may be made use of for dismounting the end plates by placing the tiller frame on the ground in such a manner that its lateral end to be operated on is raised above the ground surface. This provision results in the additional important advantage that a baffle body designed in the manner described contributes to an improved distribution of the snow and is particularly effective to prevent the formation of lateral ridges at the lateral ends of the snow tiller.

According to a further advantageous aspect, the tiller frame has a tiller frame surface facing towards the track surface and having its edges formed with a pair of mounting grooves for receiving a levelling attachment therein. This permits also the levelling attachment to be rapidly and simply replaced by merely inserting it into the mounting grooves. A lateral fixing of the levelling attachment may be achieved by the provision that the end plates in their mounted state cover at least one of the mounting groove openings at the lateral ends of the tiller frame to thereby render any additional fixing means for the levelling attachment superfluous.

In accordance with a preferred embodiment, the levelling attachment comprises a leading portion of triangular cross-section secured to the tiller frame along a first triangle side, a second triangle side being formed as a rigid compaction surface extending downwards and rearwards from the tiller frame and connected at its rear end to a plate-shaped flexible trailing portion extending substantially parallel to the second triangle side in its relaxed state, and substantially horizontally when under load, a third triangle side being formed as a support member extending from the rear end of the second triangle side to the tiller frame.

The side of the levelling attachment facing the track surface is preferably provided with at least one transverse row of bead-shaped ribs longitudinally extending in the direction of travel.

A first transverse row of such ribs is preferably disposed on the underside of a web portion with its ribs extending to locations on the second forwards facing triangle side of the rigid leading portion. A levelling attachment of this type is known from DE-GM No. 85 22 791 likewise originating from the present applicant.

The durability of the snow tiller may be further improved by the provision that the ribs of the first transverse row are formed of a hard and wear-resistant material.

The ribs of the transverse rows to the rear thereof in the direction of travel may consist of a soft material. The levelling attachment is preferably made of polyurethane.

The wear-resistance of the first transverse row may be improved in a simple manner by carborundum particles embedded in the ribs of the first transverse row. This provision does not noticeably increase the weight of the levelling attachment, so that its replacement is not encumbered thereby.

According to another embodiment, the ribs of the first transverse row have their sides facing the track surface covered with spring steel sheet. This sheet may be relatively thin, because the ribs of the first transverse row impart a certain form-stability thereto, so that the sheet may be applied thereto merely as a wear-reducing covering. The spring steel sheet may either be bolted to the levelling attachment, or it may be inserted into the forward mounting groove of the tiller frame together with the levelling attachment.

According to an alternative embodiment, the spring steel sheet alone may form the downwards and rearwards extending second triangle side of the levelling attachment and have its rear end connected to the plate-shaped flexible portion. This construction of the levelling attachment results in a saving of material and a corresponding reduction of the weight of the levelling attachment to thereby facilitate the handling of the snow tiller with regard to replacement of the levelling attachment.

The ribs of the first transverse row may also be formed as metal skid provided with anchoring projections and secured to the levelling attachment by having the anchoring projections embedded therein.

A wear-reducing and thus maintenance-saving effect is achieved by a substantially drop-shaped configuration of the ribs, which is also effective to reduce their resistance or drag in the snow.

In an embodiment in which the ribs are designed to have a tip portion facing in the direction of travel and a divergent trailing portion, a transverse compaction of the snow is achieved in addition to the reduction of wear, resulting in a particularly well prepared track.

Figure 2:
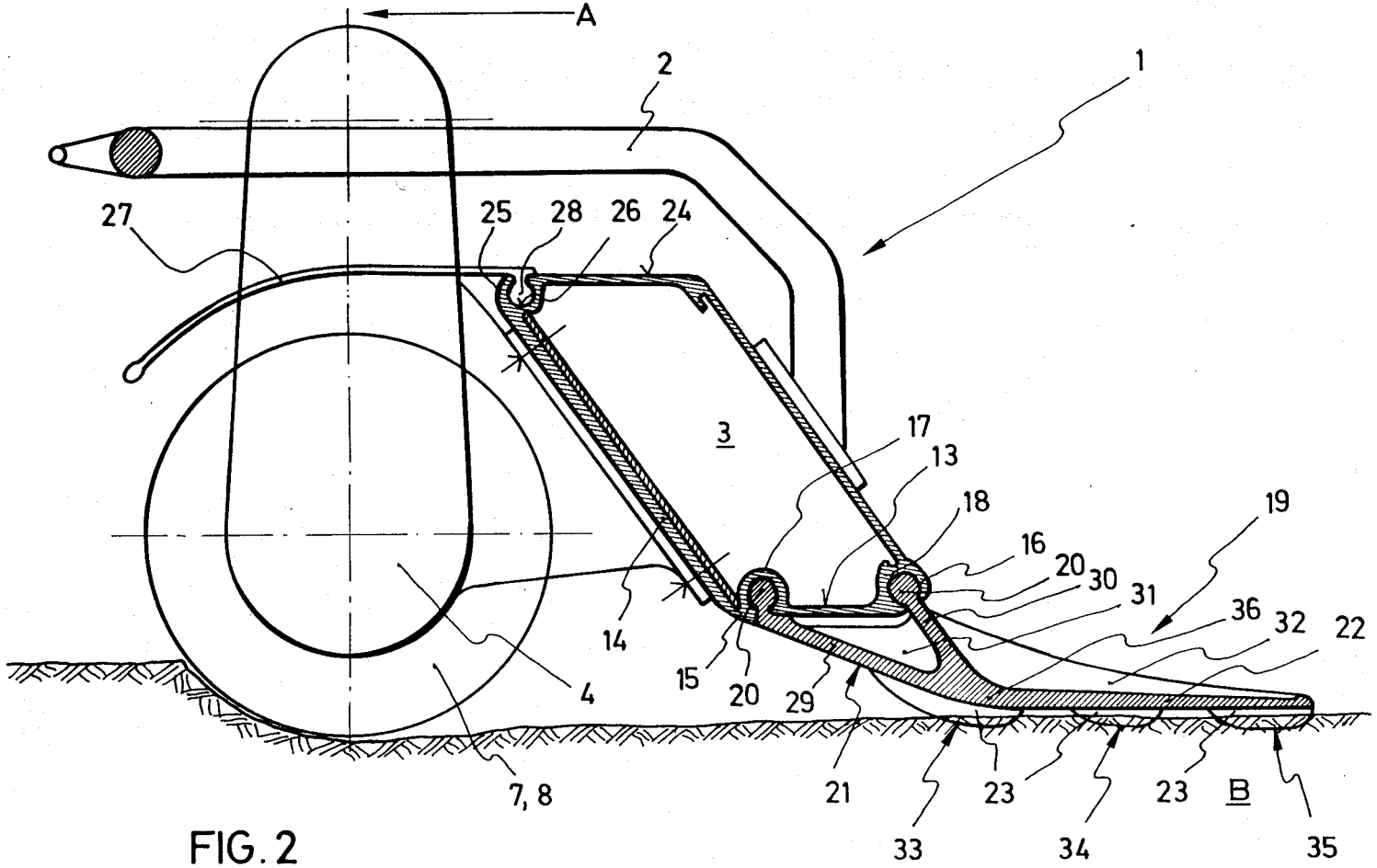
Figure 3:
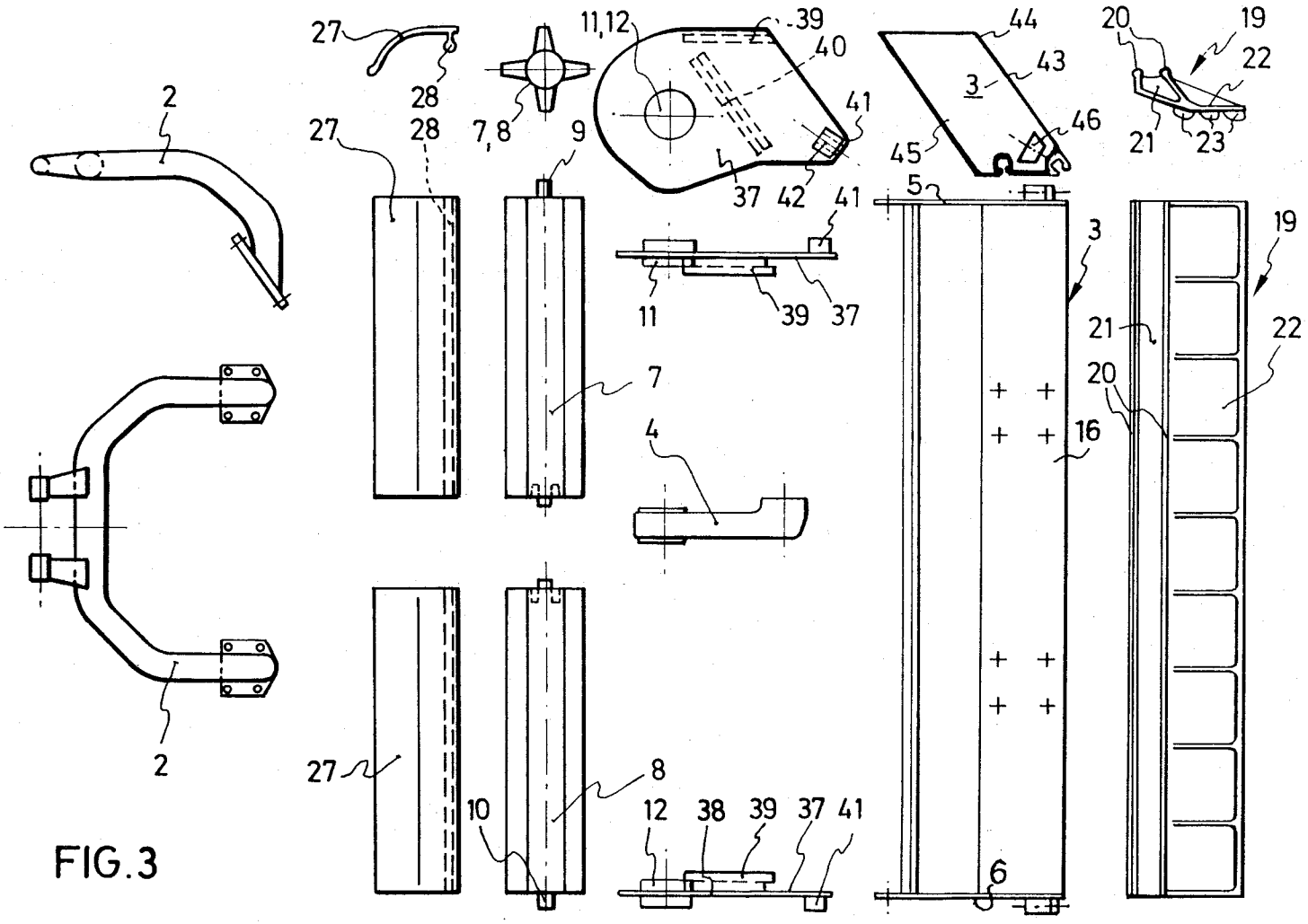
Figure 4:
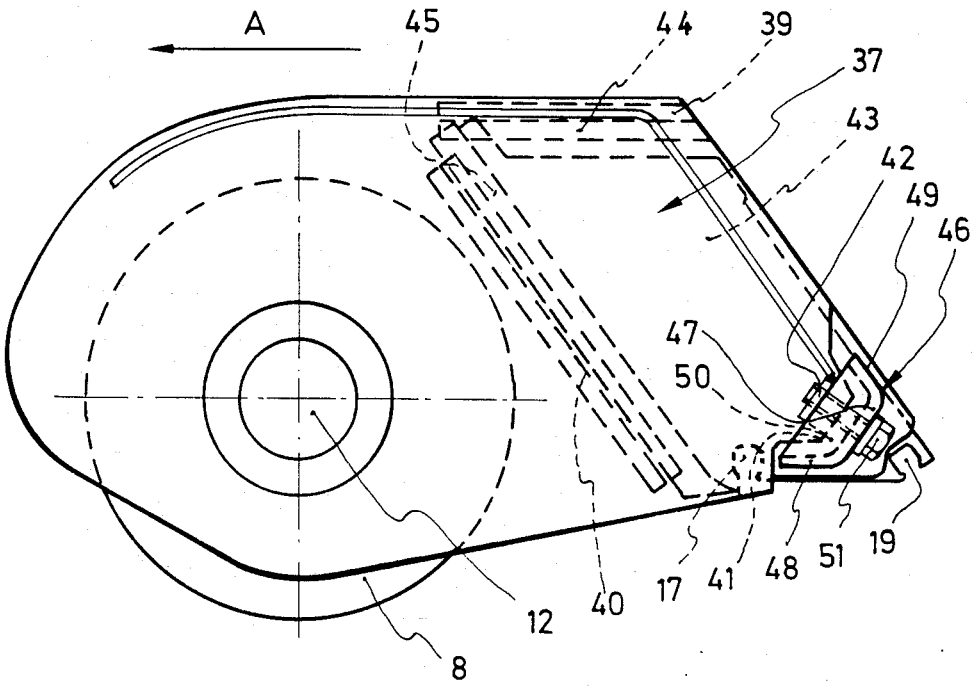
Figure 5:
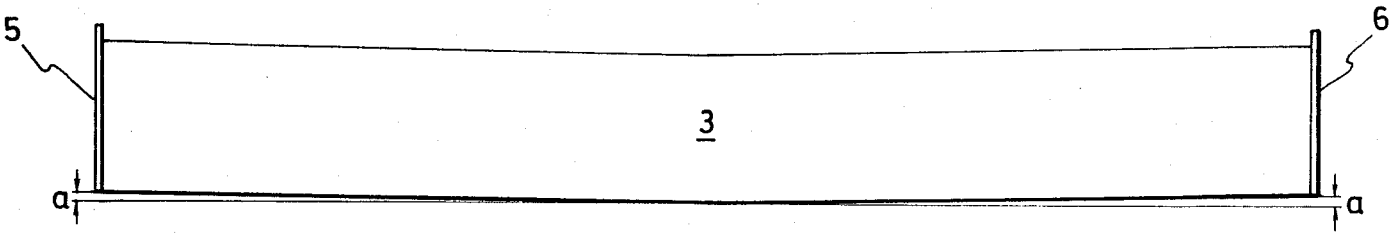
Figure 9:
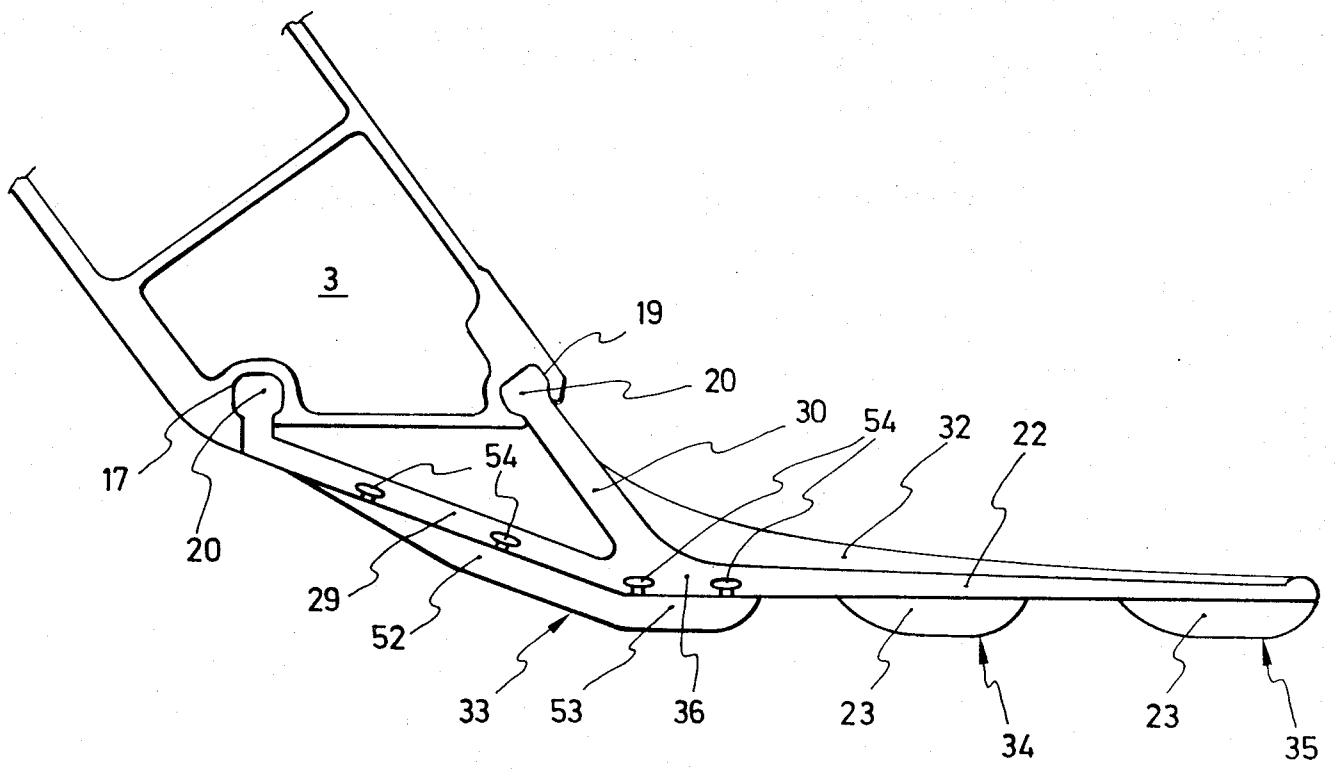
Figure 10:
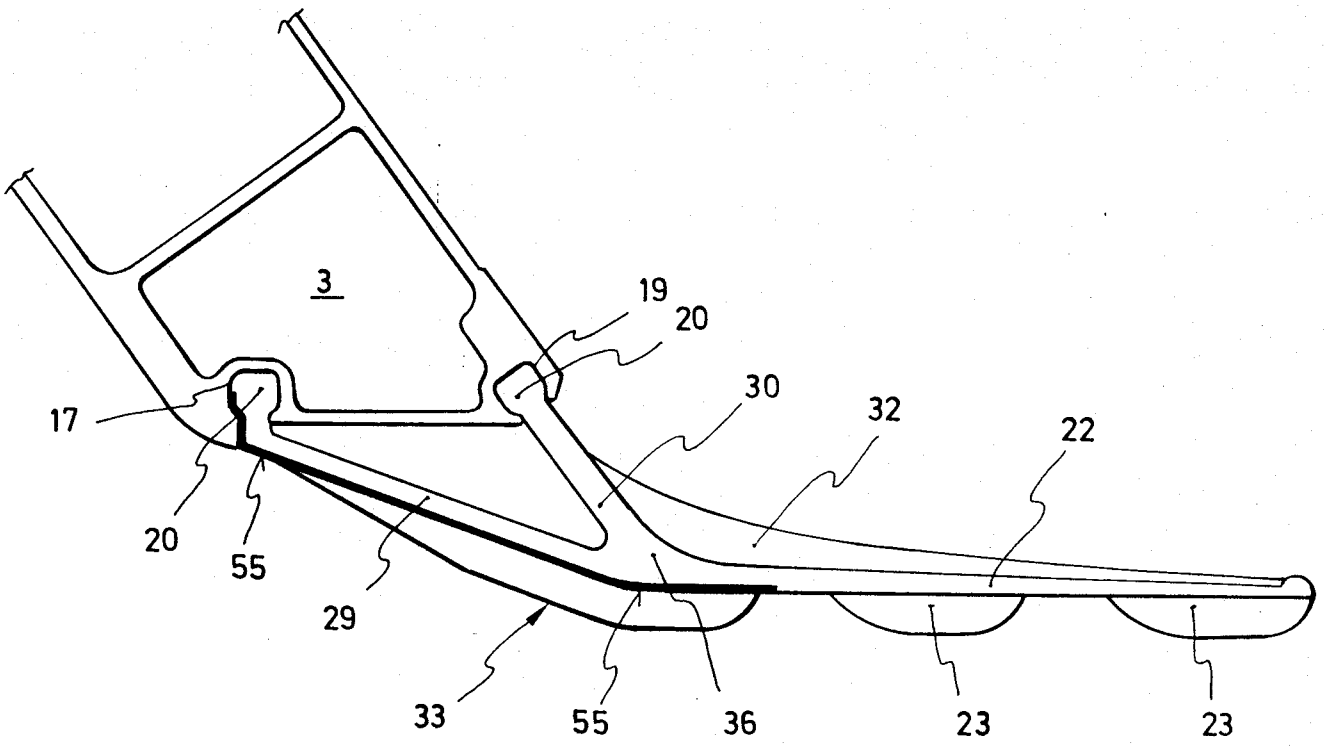
Figure 11:
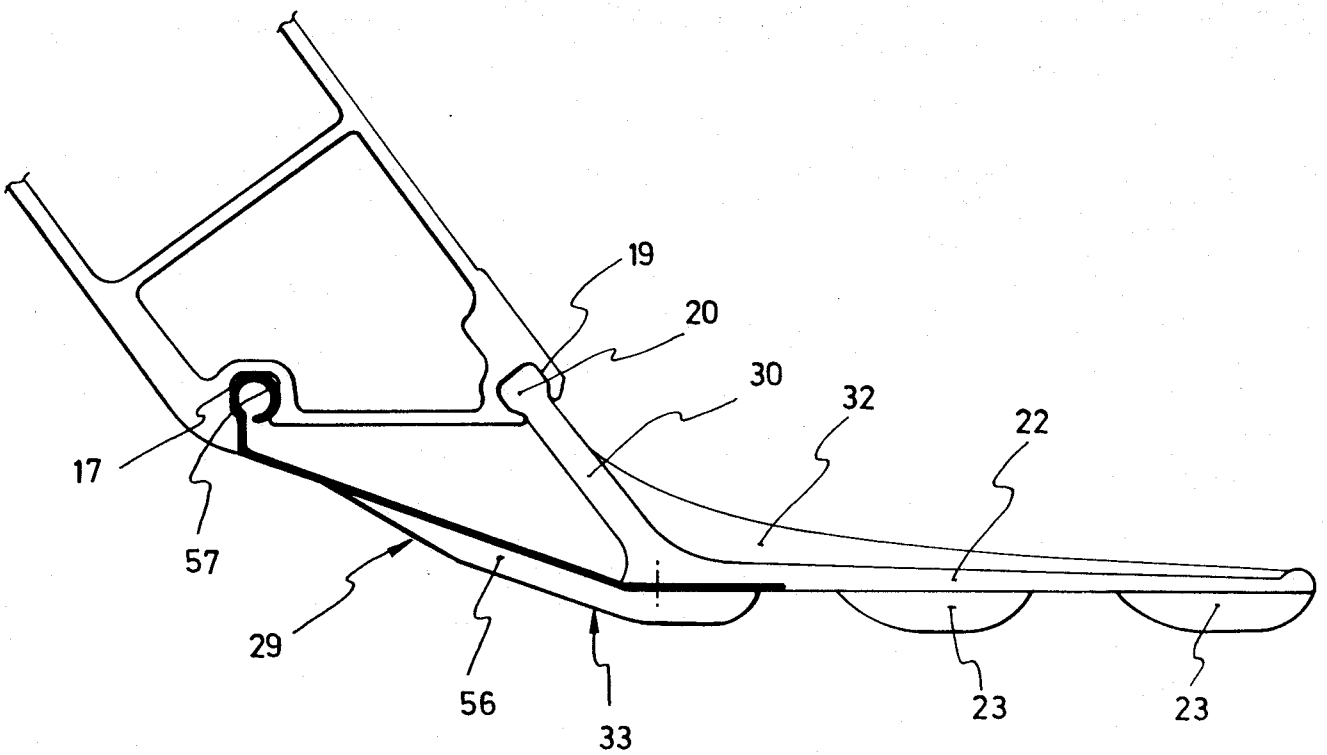

Embodiments of the invention shall now be described by way of example with reference to the accompanying drawings, wherein:

FIG. 1 shows a partially broken top plan view of a snow tiller according to the invention, FIG. 2 shows a sectional view of the snow tiller according to the invention, taken along line II—II in FIG. 1, FIG. 3 shows a sideview and top plan view of the snow tiller according to the invention in disassembled state, FIG. 4 shows a sideview of part of the snow tiller, FIG. 5 shows a front view of the tiller frame of the snow tiller in the dismounted state, FIG. 6 shows a sideview of a levelling attachment, FIG. 7 a bottom plan view of part of the levelling attachment, FIG. 8 shows a sectional view of the levelling attachment of FIG. 7 taken along the line VIII—VIII, FIG. 9 shows another embodiment of the levelling attachment in a sideview, FIG. 10 shows a sideview of a further embodiment of a levelling attachment, and FIG. 11 shows a sideview of a still further embodiment of the levelling attachment.

As particularly shown in FIG. 1, the snow tiller 1 comprises a carrier frame 2 for mounting on the rear of a track maintenance vehicle not shown, and a baffle body 3 secured to carrier frame 2 and extending over the full width of the snow tiller.

Carrier frame 2 is of bifurate shape and bolted to baffle body 3 at symmetric locations with respect to the center of snow tiller 1. Baffle body 3 itself is formed as a central tiller frame to which the components to be described are attached in a modular arrangement.

Bolted to the center of carrier frame 2 or baffle body 3, respectively, is a transmission 4 for rotating a pair of tiller shafts 7 and 8 extending from both sides of transmission 4 to the lateral ends 5 and 6 of tiller frame 3. The outer ends 9 and 10 of tiller shafts 7 and 8 are supported in outer bearings 11 and 12 secured to lateral ends 5 and 6 of tiller frame 3.

As is particularly evident from FIG. 2, tiller frame 3 consists of a parallelogram-shaped tubular body made for instance of aluminum by an extrusion process. A lower parallelogram side 13 of tiller frame 3 faces towards the track surface and extends substantially parallel thereto. Connected to the leading edge of first parallelogram side 13 in the direction of travel is a second parallelogram side 14 extending obliquely upwards.

Second parallelogram side 14 is formed as a baffle surface and provided with a wear-reducing plastic coating, for instance a polyester powder coating.

Formed adjacent the leading edge 15 and is the trailing edge 16 of first parallelogram side 13 are mounted grooves 17 and 18 extending over the full width of tiller frame 3.

A levelling attachment 19 is secured to tiller frame 3 by the insertion of mounting projections 20 formed thereon into mounting grooves 17 and 18. Projections 20 cooperate with mounting grooves 17 and 18 in the manner of a dovetail connection, so that additional means for securing levelling attachment 19 are not required. Levelling attachment 19 extends over the full width of snow tiller 1 and is made of a plastic material. It comprises a rigid leading portion 21 of substantially triangular cross-section and connected to the rear end thereof a plate-shaped flexible trailing portion 22.

The leading triangle side 29 in the direction of travel of rigid portion 21 extends downwards and rearwards from leading parallelogram side 14 of tiller frame 3, the angle of inclination of triangle side 29 with respect to the horizontal being smaller than that of leading parallelogram side 14 of tiller frame 3. Plate-shaped flexible portion 22 is connected to the trailing end of triangle side 29. A third triangle side 30 extends from rear projection 20 to the trailing end of second triangle side 29. Formed between the two triangle sides 29 and 30 are vertical stiffening ribs 31 extending parallel to one another in the direction of travel.

Further stiffening ribs 32 extend from third triangle side 30 parallel to one another in the direction of travel along the top surface of flexible portion 22 to the rear end thereof. The height of stiffening ribs 32 connected to plate-shaped portion 22 decreases from third triangle side 30 to the rear end of plate-shaped portion 22.

The side of levelling attachment 19 facing towards the track surface B is provided with three transverse rows 33, 34 and 35 of bead-shaped ribs 23 longitudinally extending in the direction of travel A. Ribs 23 of first transverse row 33 extend from the lower end of forwards facing triangle side 29 of rigid portions 21 to locations on the underside of a horizontally extending rigid web portion 36 extending between rigid portion 21 and flexible portion 22 of levelling attachment 19.

Provided on the underside of flexible portion 22 of levelling attachment 19 at a spaced location from first transverse row 33 is a second transverse row 34 of bead-shaped ribs 23. At a further spaced location a third transverse row 35 is provided with the ribs 23 thereof extending to the rear end of flexible portion 22.

The top surface 24 of tiller frame 3 opposite parallelogram side 13 has its leading end portion formed with a further mounting groove 26 extending over the full width of tiller frame 3. Secured in mounting groove 26 is a cover shield 27 made of a flexible plastic material and extending forwards in the direction of travel in alignment with parallelogram side 24 to terminate in a downwardly directed arcuate end portion. In the same manner as levelling attachment 19, cover shield 27 is formed with a projection 28 adapted to be received in mounting groove 26 in the manner of a dovetail connection, so that additional means for securing cover shield 27 are not required. Cover shield 27 is preferably subdivided into two separate parts each extending from transmission 4 to the respective lateral end 5 or 6 of tiller frame 3.

Tiller shafts 7 and 8 have respective ends thereof inserted into transmission 4 and into outer bearings 11 and 12 bolted to lateral ends 5 and 6 of tiller frame 3, as partially shown in FIG. 1.

FIG. 3 shows both top plan views and side views of the individual components of snow tiller 1. From this figure it is evident that snow tiller 1 is composed of a relatively small number of parts which are readily exchangeable. All components subjected to wear are mounted on central tiller frame 3, so that, depending on the wear of the snow tiller, either tiller frame 3 may be bodily dismounted from carrier frame 2 to be replaced by a new one, or individual worn components may be replaced.

As further shown in FIG. 3, and particularly in FIG. 4, each outer bearing 11, 12 is secured to a respective end plate 37. For simplicity's sake only the lefthand end plate 37 shall be described in the following, it being understood that the righthand end plate is an identical mirror-image of the lefthand one.

Secured to the side 38 of end plate 37 facing towards tiller frame 3 is a pair of undercut bars 39 and 40 having an L-shaped cross-sectional configuration and arranged in the shape of the letter V. In the embodiment shown, the angle included by undercut bars 39 and 40 is substantially equal to the angle included by upper parallelogram side 24 and forwards-facing parallelogram side 14 of tiller frame 3.

The shape of end plate 37 substantially conforms to the cross-sectional shape of tiller frame 3. At the end of end plate 37 opposite undercut bars 39 and 40, a tongue 41 is bent out of the plane of end plate 37 towards the side facing away from undercut bars 39 and 40. A nut 42 is welded to the rear side of tongue 41. The axial direction of nut 42 is substantially aligned with the bisector of the angle included by the two undercut bars 39 and 40, in the embodiment shown more accurately with the diagonal of a parallelogram.

As evident from FIG. 3, both lateral ends 5 and 6 of tiller frame 3 have a respective end cover 43 welded thereto. End cover 43 is formed to project beyond upper and forwards-facing parallelogram sides 24 and 14, respectively, of tiller frame 3. Along the other parallelogram sides end cover 43 does not project beyond tiller frame 3, the underside of the parallelogram being formed with cutouts giving access to mounting grooves 17 and 18 at the leading and trailing edges 15 and 16, respectively.

The projecting portions of end cover 43 form respective bars 44 and 45 extending along upper side 24 and forwards-facing parallelogram side 14 of tiller frame 3. The thickness of bars 44 and 45 is selected to conform to the width of the undercut of bars 39 and 40 on end plate 37. The bars and undercut bars are not necessarily continuous as shown in the drawings, but may also be composed of shorter individual sections.

An insertion pocket 46 opening towards the upper front edge 25 of tiller frame 3 is welded to the outer face of end cover 43 adjacent the rear edge 16 of tiller frame 3. Insertion pocket 46 has a bottom wall 47 and a pair of sidewalls 48 and 49 extending therefrom parallel to the adjacent parallelogram sides. The side of insertion pocket 46 facing away from tiller frame 3 is closed by an outer wall 50.

Bottom wall 47 is formed with an opening for a fixing bolt 51 to extend therethrough.

With particular reference to FIG. 4, undercut bars 39 and 40 are in overlapping engagement with projecting edge portions 44 and 45 of end cover 43 in the mounted state of end plate 37. Tongue 41 with nut 42 is received in insertion pocket 46, with fixing bolt 51 extending through the opening in bottom wall 47 into threaded engagement with nut 42 of end plate 37.

Between the end of tongue 41 and bottom wall 47 of insertion pocket 46 there remains a certain gap permitting undercut bars 39 and 40 to be pulled into clamping engagement with projecting edge portions 44 and 45, respectively, by tightening fixing bolt 51.

FIG. 5 shows a front view of the tiller frame 3 shown in FIG. 3. As seen in this figure, tiller frame 3 is configured to have a lowermost center portion with two lateral portions extending slightly upwards therefrom to a level a at outer ends 5 and 6. In the case of a tubular profile member this configuration may be readily obtained by cooling one side, in this case side 24, at a faster rate than another side, in this case side 13, during the extrusion process.

FIGS. 6 to 8 show another embodiment of levelling attachment 19 comprising ribs 23 of a drop-shaped configuration, as clearly seen in the bottom plan view of FIG. 7. All ribs 23 have in common that their drop configuration converges forwards in the direction of travel, so that a pointed end portion 52 faces forwards in the direction of travel, with a trailing portion 53 connecting thereto being of increasing width. Similar to the ribs of levelling attachment 19 shown in FIG. 2, drop-shaped ribs 23 present the shape of streamlined pods in cross-section (cf. FIG. 8).

The pointed forward end portions 52 of ribs 23 of first transverse row 33 extend over the full length of forwards-facing triangle side 29 of rigid portion 21 of levelling attachment 19 to terminate at locations substantially below forward projection 20. The width of relatively long pointed end portions 52 of ribs 23 in first transverse row 33 increases rearwards in the direction of travel, with a consequent narrowing of the space remaining therebetween.

Ribs 23 of first transverse row 33 are formed of a wear-resistant material. While the entire levelling attachment 19 may be made of polyurethane, the wear-resistance of ribs 23 of first transverse row 33 may be increased by embedding carborundum particles in the polyurethane of this particular portion.

Another possibility of improving the wear-resistance of ribs 23 of first transverse row 33 is shown in FIG. 9. In this embodiment, ribs 23 of first transverse row 33 are made of a metal or a thermosetting plastic material and are secured to levelling attachment 19 by means of four anchoring projections 54 embedded in the material of forwards-facing triangle side 29 and rigid web portion 36.

A further possibility of improving the wear-resistance of ribs 23 is shown in FIG. 10. In this embodiment ribs 23 of first transverse row 33 are covered with a spring steel sheet 55. Steel sheet 55 is inserted into forward mounting groove 17 together with forward projection 20, to be retained therein in the manner of a dovetail connection. A trailing portion of spring steel sheet 55 is bolted to rigid web portion 36 of levelling attachment 19. Spring steel sheet 55 may also be bolted to a forwards-facing triangle side 29 at locations below forward projection 20, in which case it would not have to be retained in mounting groove 17 together with projection 20.

A last example of wear-resistant forward ribs 23 is shown in FIG. 11. In this embodiment the forwards-facing triangle side 29 of rigid portion 21 is formed by a metal sheet 56. The forward end portion of sheet 56 is curled backwards to the shape of a resilient sleeve 57 adapted to be inserted into mounting groove 17 to be retained therein under resilient compression. For the remainder the shape of metal sheet 56 corresponds to that of forwardly facing triangle side 29 in the preceding embodiments. The connection of metal sheet 56 to the remainder of levelling attachment 19 is accomplished by bolting it to rigid web portion 36. The remaining part of levelling attachment 19 is made of polyurethane as in the preceding embodiments.

When assembling the snow tiller 1, levelling attachment 19 is inserted with its projections 20 into mounting grooves 17 and 18 of tiller frame 3 until its ends extend flush with lateral ends 5 and 6 of tiller frame 3. Tiller shafts 7 and 8 are then inserted into transmission 4, whereupon end plates 37 are slipped onto outer ends 9 and 10, respectively, of tiller shafts 7 and 8 with their outer bearings 11 and 12, respectively, and with their undercut bars 39 and 40 overlapping projecting edge portions 44 and 45, respectively, of end covers 43. End plates 37 are inserted in this manner to a position whereat tongues 41 with their nuts 42 are received in insertion pockets 46 so that fixing bolts 51 can be engaged with nuts 42.

Fixing bolts 51 then merely have to be tightened to thereby automatically align the respective end plate 37 and lock it in position.

As shown in FIG. 4, these operations cause end plate 37 to slide over forward mounting groove 17, so that end plate 37 is additionally effective to retain levelling attachment 19 against lateral displacement.

The disassembly of snow tiller 1 is carried out by reversing the above sequence.

The described snow tiller 1 operates as follows: The snow chunned up by tiller shafts 7 and 8 is flung against the forwardly facing parallelogram side 14 of the baffle body forming tiller frame 3. As parallelogram side 14 is coated with polyester powder, the snow will readily slide down thereon to be evenly distributed in front of forward edge 15 of tiller frame 3. Due to the slightly angular configuration of tiller frame 3 shown in FIG. 5, the snow will smoothly flow off also at the outer portions of the frame, so that the tilled snow is prevented from forming lateral ridges at the outer ends 5 and 6 of tiller frame 3.

The snow then comes into contact with rigid leading portion 21 of forwardly facing triangle side 29, to be compacted by downwardly directed pressure. At the same time, however, the drop-shaped configuration of ribs 23 of first transverse row 33 is effective to cause compaction of the snow also in the lateral direction. Plateshaped flexible portion 22 with its second and third transverse rows 34 and 35 of ribs 23 finally provides for a final levelling of the snow even on a relatively strongly contoured ground surface. The ribs 23 of first transverse row 33 are usually subjected to the heaviest wear. As these ribs 23 are made of spring steel, however, or have their wear-resistance improved in another suitable manner, a substantially uniform wear of levelling attachment 19 is achieved even when snow tiller 1 operates on hard snow at a considerable penetration depth.

The levelling attachment 19 does not necessarily have to be mounted on a snow tiller, it may also be secured to a so-called levelling blade.

I claim:

1. A snow tiller for mounting on the rear of a vehicle used for track maintenance, comprising: a tiller shaft, a tiller frame extending over the width of said snow tiller between a pair of end plates provided with bearings for rotatably supporting said tiller shaft, said tiller frame having a hollow parallelogram-shaped cross section formed by oppositely disposed frame surfaces, with first bars projecting beyond two of said frame surfaces at opposite ends of said tiller frame, said first bars being arranged in a V-shaped configuration relative to one another; each of said end plates having undercut second bars secured thereto in a V-shaped configuration at the side thereof facing said tiller frame, said undercut second bars being adapted to overlap said first bars on said tiller frame and to cooperate with a fixing bolt engaging said tiller frame to establish an interlocked relationship between said tiller frame and said end plates.

2. A snow tiller according to claim 1, wherein the axis of said fixing bolt is substantially aligned in the direction of the angle bisector of said second bars.

3. A snow tiller according to claim 1 or 2, wherein said undercut second bars overlap said first bars from the outside and said fixing bolt is mounted on said tiller frame at a spaced location with respect to the said two of said frame surfaces.

4. A snow tiller according to claim 1 wherein each end of said tiller frame is provided with an insertion pocket opening towards the V-shaped configuration of the associated first bars, each of said pockets being arranged to receive a portion of the respective end plates, with said fixing bolt engaging said end plate through said insertion pocket and being formed as a tension bolt.

5. A snow tiller according to claim 1 wherein a likewise parallelogram shaped end cover is secured to a lateral end of said tiller frame so as to project beyond the cross-sectional area of said tiller frame.

6. A snow tiller according to claim 4 wherein an end portion of each of said end plates facing towards its respective insertion pocket is formed with a corresponding bent-off insertion tongue having a nut secured thereto for threaded engagement with said fixing bolt.

7. A snow tiller according to claim 1 wherein said tiller frame is formed as a baffle body and that the transverse edges of said tiller frame extend upwards from the center thereof.

8. A snow tiller according to claim 1 wherein said tiller frame has a tiller frame surface facing towards the track with its bottom edge defining a pair of forward and rearward mounting grooves for receiving a levelling attachment therein.

9. A snow tiller according to claim 8 wherein said levelling attachment comprises a leading portion of triangular cross-section secured to said tiller frame along a first triangle side, a second triangle side being formed as a rigid compaction surface extending downwards and rearwards from said tiller frame and having its rear end portion connected to a plate-shaped flexible trailing portion extending substantially parallel to said second triangle side in the relaxed state, and substantially horizontal when under load, with a third triangle side being formed as a support member extending from the rear end of said second triangle side to said tiller frame.

10. A snow tiller according to claim 9 wherein the side of said levelling attachment facing towards the track is provided with at least one transverse row of bead-shaped ribs extending longitudinally in the direction of travel of the track maintenance vehicle.

11. A snow tiller according to claim 10, wherein a first transverse row of ribs is disposed on the underside of a web member joining said second triangle side to said trailing portion, with the ribs thereof extending to a location on the second triangle side.

12. A snow tiller according to claim 11 wherein the ribs of said first transverse row are formed of a hard, wear-resistant material.

13. A snow tiller according to claim 12, wherein additional transverse rows of ribs are disposed rearwards of said first row in the direction of travel and consist of a soft material.

14. A snow tiller according to at least one of claims 8 to 13, wherein said levelling attachment consists of polyurethane.

15. A snow tiller according to claim 12 wherein said ribs of said first transverse row have carborundum particles embedded therein.

16. A snow tiller according to claim 11 wherein said ribs of said first transverse row have their sides facing the track covered by spring steel sheet.

17. A snow tiller according to claim 16, wherein said spring steel sheet is bolted to said levelling attachment.

18. A snow tiller according to claim 16 or 17, wherein said spring steel sheet is inserted into the forward mounting groove of said tiller frame together with said levelling attachment.

19. A snow tiller according to at least one of claims 16 or 17 wherein said spring steel sheet defines said downwards and rearwards extending second triangle side of said levelling attachment and has its trailing end portion connected to said plate-shaped flexible portion.

20. A snow tiller according to claim 10 wherein said ribs of said first transverse row are formed as metal skids provided with anchoring projections and are secured to said levelling attachment by having said anchoring projections embedded therein.

21. A snow tiller according to claim 10 wherein said ribs are of a drop-shaped configuration.

22. A snow tiller according to claim 10 wherein said ribs have relatively narrow tips facing in the direction of travel with divergent trailing portions extending rearwardly therefrom.

* * * * *